US009820548B1

(12) United States Patent
Tarling

(10) Patent No.: US 9,820,548 B1
(45) Date of Patent: Nov. 21, 2017

(54) APPLICATOR HAVING FORMULA CONTROL

(71) Applicant: L'Oreal, Paris (FR)

(72) Inventor: Christopher Tarling, Clark, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 15/142,617

(22) Filed: Apr. 29, 2016

(51) Int. Cl.
*A45D 34/04* (2006.01)
*A45D 34/00* (2006.01)

(52) U.S. Cl.
CPC ..... *A45D 34/04* (2013.01); *A45D 34/045* (2013.01); *A45D 2034/007* (2013.01)

(58) Field of Classification Search
CPC combination set(s) only.
See application file for complete search history.

(56) References Cited

U.S. PATENT DOCUMENTS

D374,108 S * 9/1996 Moody ..... D28/22
5,888,005 A * 3/1999 Gueret ..... A45D 34/046 401/119
6,312,182 B1 * 11/2001 Dumler ..... A46B 9/021 401/129
8,070,374 B2 * 12/2011 Gueret ..... A45D 34/045 401/126
8,191,559 B2 * 6/2012 Bickford ..... A45D 34/045 132/218
9,538,826 B2 * 1/2017 Pires ..... A45D 29/00
2002/0048482 A1 * 4/2002 Gueret ..... A45D 34/045 401/130

* cited by examiner

*Primary Examiner* — David Walczak
(74) *Attorney, Agent, or Firm* — Christensen O'Connor Johnson Kindness PLLC

(57) ABSTRACT

Cosmetic formula applicators having formula control are provided to aid in the application of a cosmetic formula to a user. In general, examples of the applicators described herein generally include a stem with a structured tip portion having a closed partition and an open partition that forms a leg segment, where the structured tip portion is configured to retain an amount of cosmetic formula for application to a user. In another aspect, the perimeter of the stem may be configured such that the elongate stem has a particular surface area depending on the cosmetic formula composition to control the dosage size. In a further aspect, the structured tip portion represents an enterprise-specific symbol.

15 Claims, 5 Drawing Sheets

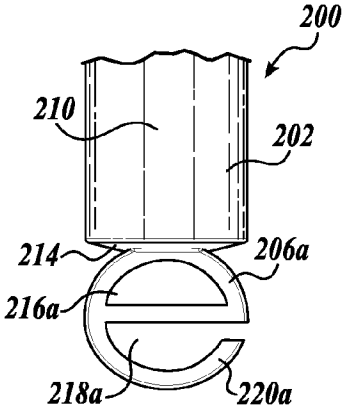
Fig. 5a.
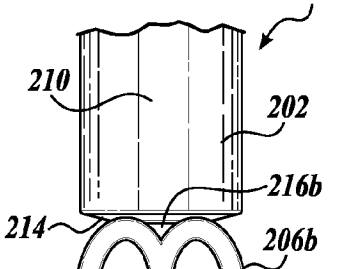
Fig. 5b.
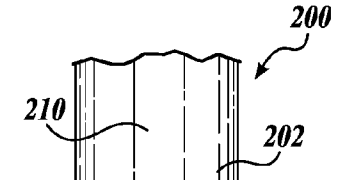
Fig. 5c.
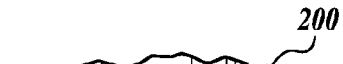
Fig. 5d.
Fig. 5e.

APPLICATOR HAVING FORMULA CONTROL

SUMMARY

The present disclosure is directed to, among other things, one or more embodiments of an applicator with formula control for applying a cosmetic formula. In an embodiment, the applicator includes an elongate stem having a first end, a second end, and a perimeter; and a structured tip portion having a closed partition and an open partition that forms a leg segment. The structured tip portion is one embodiment is coupled to the first end of the elongate stem and configured to retain an amount of the cosmetic formula for application. The perimeter of the elongate stem in one embodiment may be configured such that the elongate stem has a particular surface area.

The present disclosure is also directed to one or more embodiments of a cosmetic formula container. In an embodiment, the cosmetic formula container includes a container body having a neck and an interior cavity configured to hold a quantity of cosmetic formula. A cap is removably couplable to the neck for enclosing the cosmetic formula within the container. The container also includes an applicator coupled to the cap and extending into the interior cavity. The applicator in one embodiment comprising an elongate stem having a structured tip portion coupled to an end of the elongate stem opposite the cap. The structured tip portion in one embodiment may include a closed partition and an open partition having a leg segment configured to provide spring bias upon contact with a surface. The applicator may be configured in one embodiment to retain an amount of the cosmetic formula for application.

In accordance with any of the embodiments described herein, the structured tip portion may represent an enterprise-specific symbol.

In accordance with any of the embodiments described herein, the structured tip portion may include a physical shape and color indicative of an enterprise-specific symbol.

In accordance with any of the embodiments described herein, the structured tip portion may include a physical shape indicative of a brand, the physical shape indicative of the brand sized and configured to apply an amount of the cosmetic formula to a biological surface.

In accordance with any of the embodiments described herein, the structured tip portion may include a physical shape representative of at least one alphanumeric character.

In accordance with any of the embodiments described herein, the applicator may further include a cap coupled to the second end of the elongate stem.

In accordance with any of the embodiments described herein, the cap may have an internal threaded bore to interface with a bottle.

In accordance with any of the embodiments described herein, the elongate stem may include an indentation along a portion of the elongate stem from the first end toward the second end, the indentation configured to increase surface area.

In accordance with any of the embodiments described herein, the elongate stem may include a texture on a surface of the elongate stem from the first end toward the second end, the texture configured to increase surface area.

In accordance with any of the embodiments described herein, the structured tip portion may include a texture on a surface of the structured tip portion configured to increase surface area.

In accordance with any of the embodiments described herein, the leg segment may be configured to provide spring bias upon contact with a surface.

In accordance with any of the embodiments described herein, the elongate stem may include a material selected from the group consisting of nylon, high-density polyethylene (HDPE), low-density polyethylene (LDPE), plastic, thermo plastic, polymer, resin, thermal resin, or combinations or composites thereof.

In accordance with any of the embodiments described herein, the applicator may further include an indentation along at least a portion of the elongate stem from the structured portion toward the cap, wherein the indentation may be configured to increase the surface area of the elongate stem for increased cosmetic formula retention.

In accordance with any of the embodiments described herein, the applicator may include a texture on at least a portion of a surface of the elongate stem configured to increase surface area for increased cosmetic formula retention.

In accordance with any of the embodiments described herein, the applicator may further include a coupler coupled to the end of the elongate stem opposite the structured portion, the coupler having a coupling portion projecting from the body away from the elongate stem for coupling the applicator to the cap.

In accordance with any of the embodiments described herein, the cap may couple to the neck of the container body using a mechanical coupling selected from the group consisting of threads, press fit, turn to lock, and interlock.

In accordance with any of the embodiments described herein, the applicator may have a length such that the structured portion is between about 1/10 of 1 millimeter and about 5 millimeters away from an interior bottom of the container body when the cap is coupled to the neck of the container body.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein:

FIGS. 5*a*-5*e* are front views of various embodiments of a structured portion of an applicator in accordance with aspects of the present disclosure.

DETAILED DESCRIPTION

The following description provides several examples that relate to cosmetic applicators. In that regard, application of a wide variety of cosmetic formulas to human nails and cuticle areas is a common practice. Some examples of such cosmetic formula include cuticle treatment, moisturizers, cuticle conditioners, nail supplements, nail proteins, etc. To apply the cosmetic formula, an applicator can be used. Generally described, a conventional applicator typically includes a brush at one end that retains an amount of formula (a "dosage") for application to the nails and/or cuticle area. The opposite end of the applicator is grasped during use.

Figure 1:
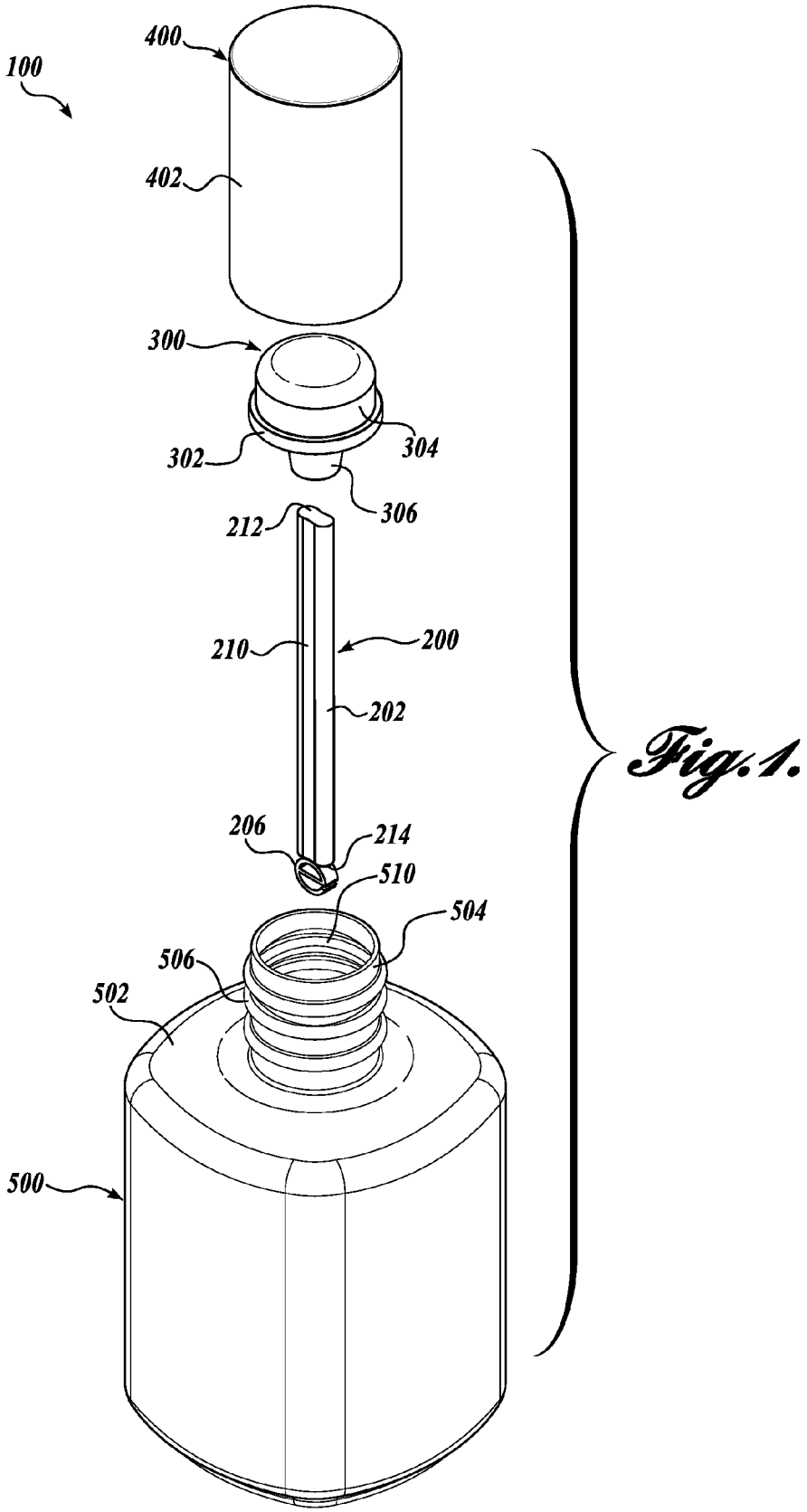
FIG. 1 is an exploded view of one representative embodiment of a cosmetic formula container in accordance with an aspect of the present disclosure.

FIG. 1 shows one representative embodiment of an applicator for implementing one or more methodologies or technologies, such as, for example, providing a formula control when using cosmetic formula having suitable viscosity to form droplets. For example, in one aspect of embodiments of the present disclosure, the conventional brush is replaced by a structured portion, as described in greater detail below. For certain cosmetic formulas, controlling the dosage—the total amount of formula retained by an applicator without rewetting—may, for example, provide a better user-experience, maximize the applications per bottle, and/or increase the efficacy of the cosmetic treatment.

In certain applications of cosmetic formula, such as a salon environment where a single applicator may be used to apply cosmetic formula to the nails and/or cuticle areas of different users, it is undesirable to touch the human nail or cuticle area with the applicator. Touching the nail or cuticle area can transfer fungus and/or bacteria to other users, causing potential infection. To address such problems, embodiments of the present disclosure, when used with a cosmetic formula having suitable viscosity to form droplets, allows application of the cosmetic formula to the nail and/or cuticle area without touching the user. In other applications, it may be desirable to utilize the structured portion of the applicator to massage the cosmetic formula into the nail and/or cuticle area contemporaneously with the application of the cosmetic formula. Using the embodiments of the present disclosure, the cosmetic formula can be pushed into cracks and crevices of the nail and cuticle area which would otherwise be difficult to penetrate with the formula alone.

The embodiments illustrated in the FIGURES have been designed for use with cosmetic formulas applied to the user's fingernails, toenails, and the cuticle areas thereof (e.g., treatments, moisturizers, conditioners, supplements, protein, etc.). Embodiments of the present disclosure are also suitable for applying a cosmetic formula to any surface of the user's body.

Embodiments of the applicator disclosed herein are suitable for use with standard cosmetic formula bottles, among others. In one embodiment, the cosmetic formula bottle generally includes a neck and an interior cavity configured to hold a quantity of cosmetic formula. The neck is configured to interface with a cap in a removably couplable manner for enclosing the cosmetic formula within the bottle. In one embodiment, the cap is adapted to be coupled to the applicator. In certain embodiments disclosed herein, the cosmetic formula bottle is about 15 centimeters or smaller in height, about 7.5 centimeters or smaller in width or diameter, and contains less than 0.5 liters of cosmetic formula. In an embodiment, a major dimension of the cosmetic formula bottle ranges from about 2 centimeters to about 15 centimeters. In an embodiment, a major dimension of the cosmetic formula bottle ranges from about 2 centimeters to about 7 centimeters. In an embodiment, the volume of the cosmetic formula bottle ranges from about 0.08 fluid ounces (fl. oz.) to about 20 fl. oz. In an embodiment, the volume of the cosmetic formula bottle ranges from about 0.08 fluid ounces (fl. oz.) to about 3 fl. oz. In an embodiment, the volume of the cosmetic formula bottle ranges from about 0.08 fluid ounces (fl. oz.) to about 1 fl. oz. In an embodiment, the volume of the cosmetic formula bottle ranges from about 0.08 fluid ounces (fl. oz.) to about 0.5 fl. oz. In an embodiment, the volume of the cosmetic formula bottle ranges from about 2.5 milliliters (ml) to about 600 ml. In an embodiment, the volume of the cosmetic formula bottle ranges from about 2.5 milliliters (ml) to about 100 ml. In an embodiment, the volume of the cosmetic formula bottle ranges from about 2.5 milliliters (ml) to about 50 ml. In an embodiment, the volume of the cosmetic formula bottle ranges from about 2.5 milliliters (ml) to about 15 ml.

Figure 2:
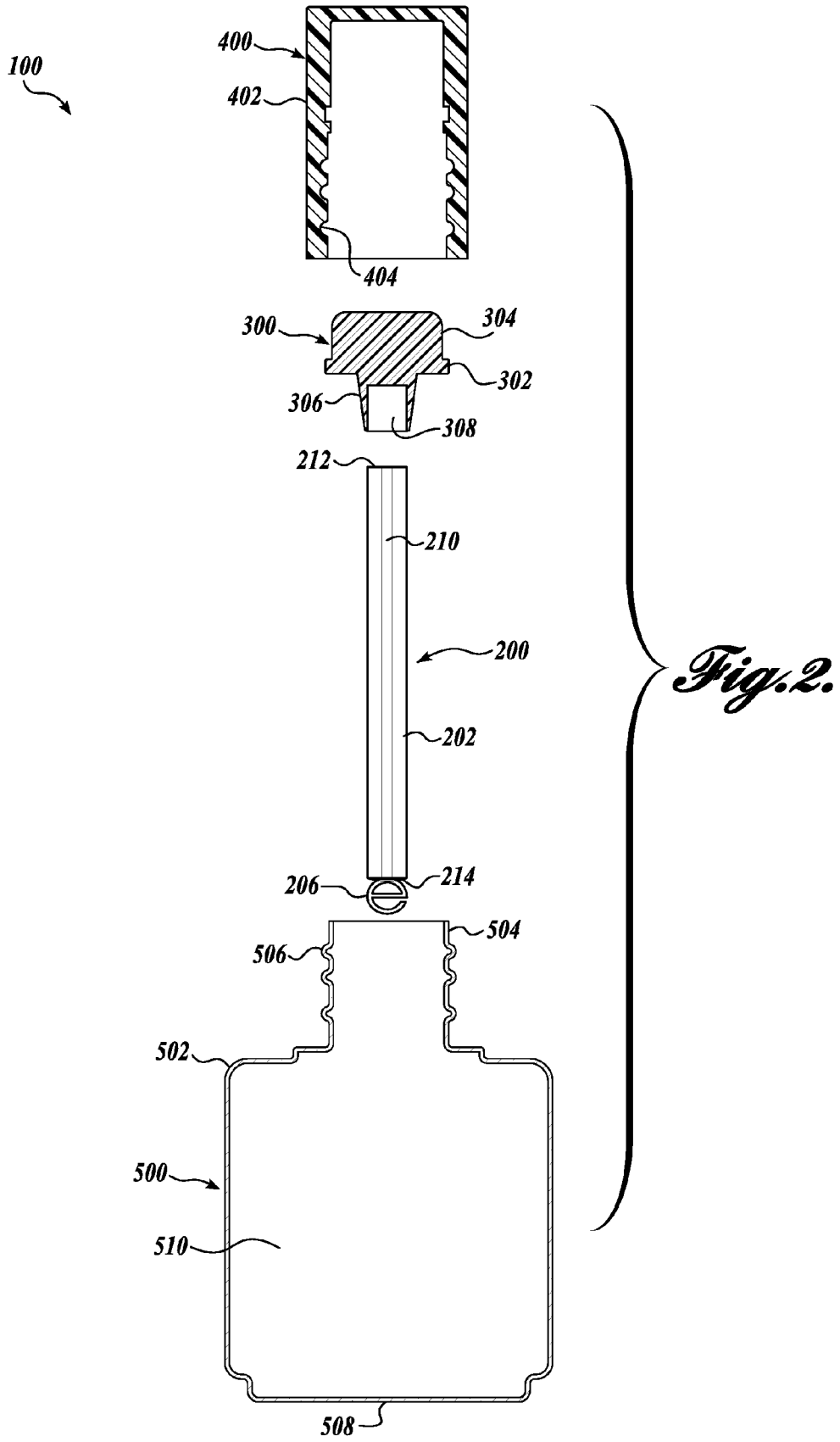
FIG. 2 is an exploded, cross-sectional view of the cosmetic formula container of FIG. 1.
Figure 3:
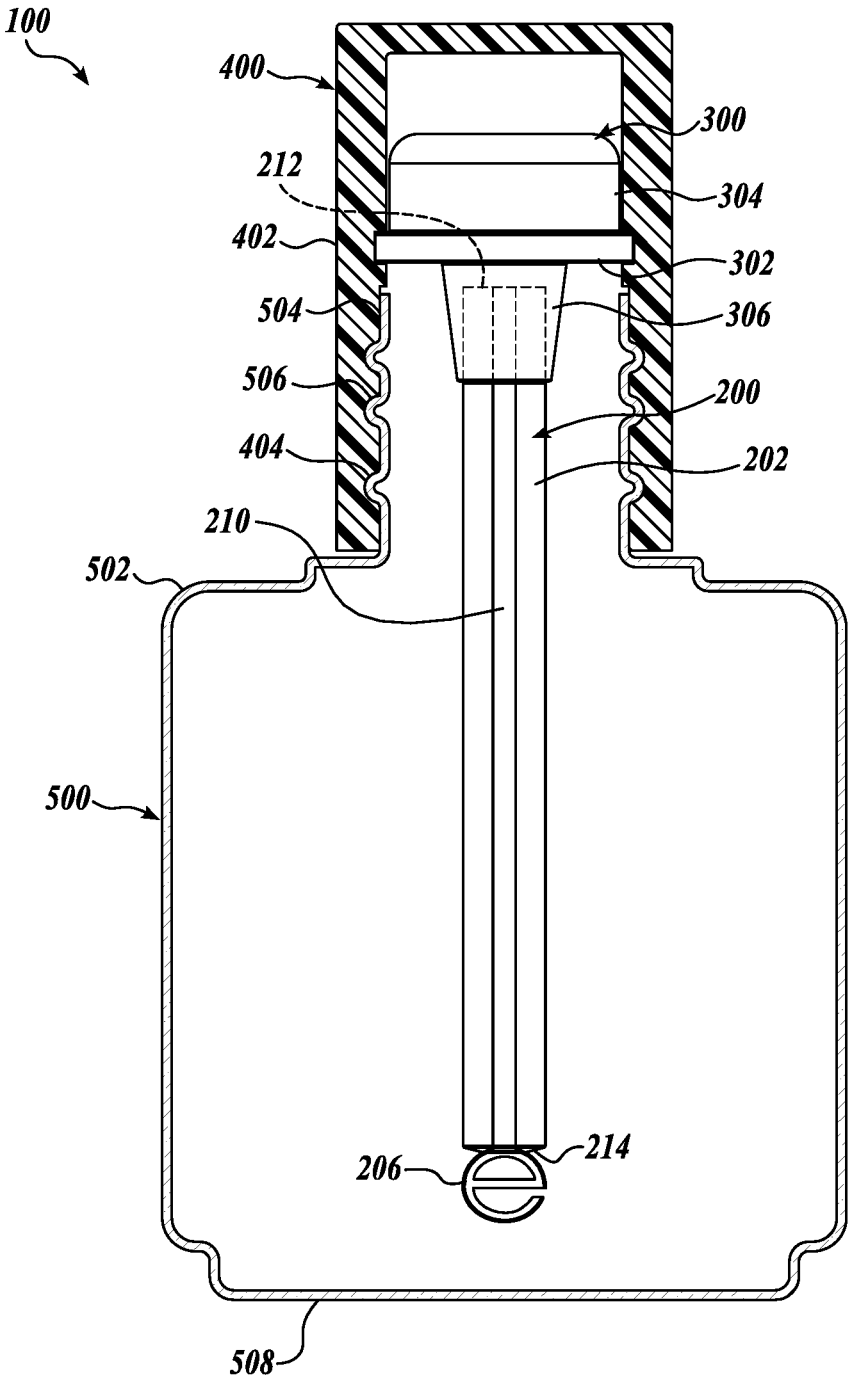
FIG. 3 is an assembled, cross-sectional view of the cosmetic formula container of FIG. 1.
Figure 4A:
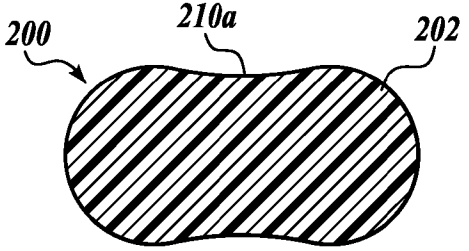
FIGS. 4*a*-4*f* are cross-sectional views of various embodiments of an elongated stem of an applicator in accordance with aspects of the present disclosure.
Figure 4B:
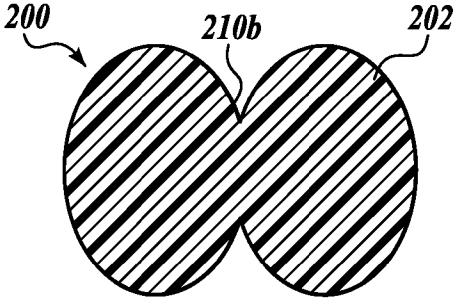
Figure 4C:
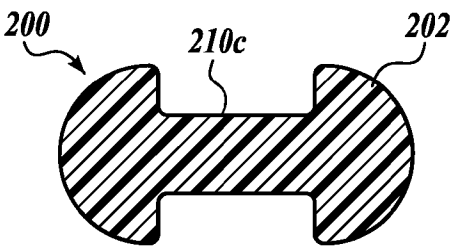
Figure 4D:
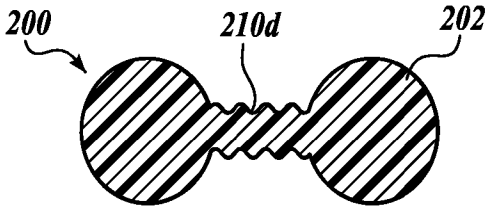
Figure 4E:
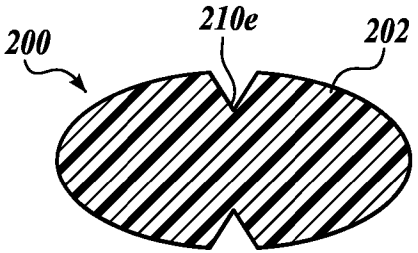
Figure 4F:
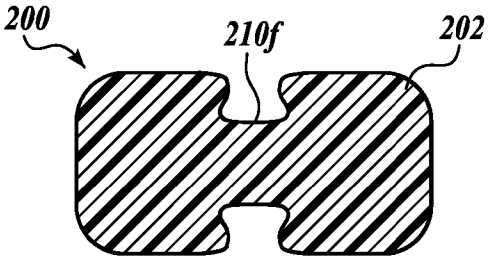

Referring now to FIGS. 1-3, there is shown one embodiment of a cosmetic formula container, generally designated 100, in accordance with one or more aspects of the present disclosure. In the illustrated embodiment, the cosmetic formula container 100 generally includes an applicator 200, a cap 400, and a cosmetic bottle 500. In some embodiments, the cosmetic formula container 100 may include an applicator coupler 300 for coupling the applicator 200 to the cap 400. When assembled, the cap 400 is removably coupled to the cosmetic bottle 500, and the applicator 200 extends into the interior of the cosmetic bottle 500. It will be appreciated in some embodiments the applicator 200 can be directly coupled to the cap 400, omitting the applicator coupler 300. In yet other embodiments, the applicator 200 is a separate device, which is not coupled to the cap 400.

Still referring to FIGS. 1-3, each component of the container 100 will be described in more detail. FIGS. 1-3 illustrate one embodiment of the applicator 200 in accordance with an aspect of the present disclosure. As shown in FIG. 1, the applicator 200 includes an elongated stem 202 having a distal end 214 to which a structured portion 206 is fixedly secured, integrally formed, or otherwise disposed. In an embodiment, the structured portion 206 forms part of a cosmetic product applicator including a tip portion having a physical shape and color indicative of an enterprise-specific symbol.

In one embodiment, to attach the structured portion 206 to the elongated stem 202, the structured portion 206 is formed contemporaneously and from the same material as the elongated stem 202, e.g., during a plastic or rubber molding process. In other embodiments, the structured portion 206 is attached to the elongated stem 202 using a suitable mechanical connection, for example, with an adhesive or an interlocking feature, and is formed from any suitable material. As a non-limiting example, the stem 202 and/or the structured portion 206 can be made from plastic, such as nylon; high-density polyethylene (HDPE); low-density polyethylene (LDPE); etc.; or a mixture, blend, or copolymer thereof. In an embodiment, the stem 202 and/or the structured portion 206 is formed from plastics, thermo plastics, polymers, resins, thermal resins, and the like, or combinations or composites thereof.

The elongated stem 202 of the applicator 200 is of suitable length for the elongated stem 202 and structured portion 206 to interface with the cosmetic formula within the cosmetic bottle 500. In this regard, in some embodiments, the elongated stem 202 is of a length such that the structured portion 206 contacts an interior bottom of the cosmetic bottle 500 when the cosmetic formula container 100 is closed. In other embodiments, the elongated stem 202 is of a length such that the structured portion 206 is between about 0.1 millimeters and about 5 millimeters away from the interior bottom of the cosmetic bottle 500 when the cosmetic formula container 100 is closed.

The elongated stem 202 of the applicator 200 is of suitable diameter to pass through a neck 504 of the cosmetic bottle 500 to interface with the cosmetic formula therein. In an embodiment, the elongated stem 202 can take a variety of shapes, configurations, and geometric forms including regular or irregular forms and can have a cross-section of substantially any shape including, for example, circular, triangular, square, rectangular, polygonal, regular or irregular shapes, and the like, as well as other symmetrical and asymmetrical shapes, or combinations thereof. In embodiments of the present disclosure, the diameter of the elongated stem 202 is between about 1 millimeter and about 25 millimeters. In some embodiments, the elongated stem 202 has a uniform cross section from a proximal end 212 to the distal end 214, or sections thereof. In other embodiments, the elongated stem 202 has a variable cross section from the proximal end 212 to the distal end 214, or sections thereof.

As shown in FIGS. 4*a*-4*f*, the cross-section of the elongated stem 202 has an outer perimeter shape that is selected to provide the desired structural rigidity of the applicator 200 and to control the amount of cosmetic formula that is retained by the applicator 200 upon removal from the cosmetic bottle 500—i.e., the total dosage, which is the amount that may be extracted from the applicator 200 before requiring a reapplication of the cosmetic formula. The cosmetic formula dosage can be controlled by adjusting a surface area of the elongated stem 202, which is related to the perimeter and surface texture (not shown) of the cross section. In this regard, a larger outer perimeter generally increases the dosage held by the applicator 200, while a shorter outer perimeter generally reduces the dosage held by the applicator 200. Likewise, the roughness, depth, waviness, and form of the surface texture can influence the cosmetic formula dosage of the elongated stem 202, generally increasing the surface area from a baseline of a smooth surface.

In some embodiments, a stem indentation 210 is included to increase the size of the outer perimeter of the elongated stem 202. As shown in the comparison of FIGS. 4*a*-4*f*, the stem indentations 210*a*, 210*b*, 210*c*, 210*d*, 210*e*, and 210*f* are of a shape to provide the desired structural rigidity and dosage of the elongated stem 202. In other embodiments, the stem indentation 210 may be any other suitable shape. In the illustrated embodiments, each cross-sectional view generally has two stem indentations 210*a*-210*f*; although, any number of indentations may be suitably used with the embodiments of the present disclosure. Likewise, in further embodiments, the elongated stem 202 has protrusions (not shown) in place of one or more of the stem indentations 210*a*-210*f*.

The stem indentations 210*a*, 210*b*, 210*c*, 210*d*, 210*e*, and 210*f* are shown in the illustrated embodiments of FIGS. 4*a*-4*f* as symmetric about a horizontal centerline (not shown) of the elongated stem 202. However, in other embodiments, any indentation configuration is used to control the dosage, structural rigidity, and aesthetic appeal of the elongated stem 202. In this regard, the elongated stem 202 may omit an indentation, may include a single indentation, or may have more than two indentations. Likewise, the indentations may be non-symmetric in cross-section of the elongated stem 202. As stated above, the indentations of the elongated stem 202 may be present along either a portion or the entire length of the elongated stem 202.

Now referring to FIGS. 5*a*-5*e*, non-limiting examples of embodiments of the structured portion 206 of the elongated stem 202 are shown. As illustrated, the structured portions 206*a*, 206*b*, 206*c*, 206*d*, and 206*e* further control the dosage of the cosmetic formula, and provide a massaging functionality, described herein, for further penetration of the cosmetic formula in cracks and crevices of the user's nail and cuticle areas. As described with regard to the elongated stem 202 above, the structured portions 206*a*-206*e* in some embodiments may include texture to increase the surface area, thereby altering the dosage retained by the applicator 200.

As shown in FIG. 5*a*, the structured portion 206*a* in one embodiment is generally of the shape of a lower-case "e." This shape provides benefits to the dosage control and/or the massaging functionality. As shown, the structured portion 206*a* includes a closed partition 216*a* and an open partition 218*a*. The closed partition 216*a* is generally a "loop" of material with an opening, as shown, characterized by material fully surrounding the opening. In contrast, the open partition 218*a* has an opening, but does not have material fully surrounding the opening. In this regard, the material partially surrounding the opening of the open partition 218*a* forms a leg segment 220*a*. The leg segment 220*a* provides a flexible section of the structured portion 206*a* for the massaging functionality of the applicator 200. As a result of the geometry of the structured portion 206*a* and the material thereof, the leg segment 220*a* is spring-like, which can form a biasing spring, tending to keep the leg segment 220*a* in position to form the "e" shape. Although illustrated embodiments of the structured portion 206*a* are generally shown with constant depth or material thickness into the page when viewed in FIG. 5*a*, the structured portion 206*a* has varying depth in other embodiments. Likewise, the thickness of material forming the "e" of the structured portion 206*a* can vary within the scope of the present disclosure.

In the illustrated embodiments of FIGS. 1, 2, 3, and 5*a*, the shape of the lower-case "e" of the structured portion 206*a* symbolizes an enterprise-specific symbol, such as a Trademark or a significant design of the manufacturer of the applicator 200. In other embodiments, the shape of the structured portion may represent any Trademark or significant design while retaining the formula control and massaging characteristics described herein. In this regard, symbols with at least one closed partition and at least one open partition are within the scope of the present disclosure.

The massaging function described herein is partially a result of the biasing spring of the leg segment 220*a*. As the applicator 200 is used to apply the cosmetic formula to the user's nail and/or cuticle areas, the leg segment 220*a* contacts the areas and provides a spring force against the surfaces. As the user moves the applicator 200 around the nail and/or cuticle areas, the leg segment 220*a* flexes and forces the cosmetic formula into cracks and crevices of the surface. As a result, greater penetration of the cosmetic formula is realized. Based on the material used in embodiments of the structured portion 206*a*, the closed partition 216*a* may also provide the effect of a biasing spring, further increasing the massaging effect of the applicator 200.

In some embodiments, the combination of the closed partition 216*a* and the open partition 218*a* provide retention and release areas for the cosmetic formula to apply at least a portion of the dosage in the form of a droplet. In this regard, the structured portion 206*a* retains cosmetic formula in conjunction with the shape of the elongate stem 202 to define the dosage.

In FIGS. 5*b*-5*e*, other shapes within the scope of the present discloser are provided. FIG. 5*b* shows a lower-case "m" including a smaller closed partition 216*b* and two open partitions 218*b*. FIG. 5*c* shows an alpha "a" with a small closed partition 216*c*, a large closed partition 216*c*', and a small open partition 218*c*. FIG. 5*d* shows an upper-case "R" including a closed partition 216*d* and an open partition 218*d*. FIG. 5*e* shows a lower-case "x" with a closed partition 216*e* and an open partition 218*e*. In other embodiments, the structured portion 206 can be any suitable shape with a combination of open and closed partitions to perform at least one of the following functions: dosage control; massaging; and representation of an enterprise-specific symbol. In some embodiments, the size of the structured portion 206 is generally of the diameter of the elongated stem 202, between about 1 millimeter and about 25 millimeters in width. In other embodiments, the structured portion 206 is of any size that allows it to pass through the opening in the neck 504 of the cosmetic bottle 500.

Returning now to FIGS. 1-3, the container also includes a cap 400 and a cosmetic bottle 500. The cosmetic bottle 500 includes bottle body 502 that forms an interior cavity 510 configured to hold a preselected quantity of cosmetic formula. Non-limiting examples of formulations include cosmetic formulations, treatment formulations, nail care formulation, cosmetic products, care products, nail polish cosmetic compositions, Ultraviolet (UV) curable cosmetic nail gel compositions, anti-fungal compositions, color cosmetic compositions, nail care cosmetic formulations, lip care cosmetic formulations, eye cosmetic formulations, eye treatment compositions, and the like.

Further non-limiting examples of formulations include cuticle care formulations (e.g., apricot cuticle oil formations, hydrating formulations, and the like); based coat formulations (e.g., strengtheners, rubber adhesives, primers, color adhesives, anti-break compositions, ridge fillers, and the like); treatment formulations (e.g., nutra-keratin formulations, bamboo extract formulations, ridge filler formulations, anti-chip formulations, and the like); top coat formulations (e.g., GEL•SETTER™, shine, polish, matte finisher, anti-chip, color adhesive, primer, quick drying, and the like); and the like. In one embodiment, the cosmetic formula includes nail care cosmetic compositions.

The cosmetic bottle also includes the neck 504 for interfacing with the cap 400. The neck 504 extends from the bottle body 502 with a smaller cross-section than the bottle body 502. The cap 400 selectively attaches to the neck 504 of the cosmetic bottle 500 using a mechanical coupling, such as press fit, turn to lock, interlock, etc. In the illustrated embodiment shown in FIG. 3, the cap 400 selectively attaches via internal cap threads 404 that engage cooperatingly configured bottle threads 506 disposed on the neck 504. In several embodiments, the threaded cap 400 is configured to closely interface with the neck 504 to provide a hermetic seal, keeping the cosmetic formula from escaping the bottle cavity 510, evaporating, etc.

In some embodiments, the cap 400 is adapted to be coupled to the applicator 200. In the embodiment shown, the applicator 200 is coupled to the cap 400 via the applicator coupler 300. In this regard, the cap 400, the applicator 200, and the applicator coupler 300 in some embodiments function as a single unit during application of the cosmetic formula to the user. In other embodiments, the cap 400 is integral to the applicator 200 such that together the components form a single unit. Still, in other embodiments, the applicator 200 remains a separate component such that the cap 400 is removed from the cosmetic bottle 500 to reveal the applicator 200 prior to application of the cosmetic formula.

Still referring to FIGS. 1-3, one embodiment of the applicator coupler 300 will be described in more detail. The applicator coupler 300 provides one representative technique for coupling the applicator 200 to the cap 400, although other techniques or methodologies can be practiced with embodiments of the present disclosure. As shown in FIGS. 1-3, the applicator coupler 300 includes a coupler body 302, a coupler protrusion 304, and a stem coupler 306. The coupler protrusion 304 is configured to interface with the cap 400 and retain the applicator coupler 300 therewith. In this regard, the applicator coupler 300 interfaces with the cap 400 using a press fit, threads, glue, or any other suitable mechanical coupling.

The stem coupler 306 is configured for attaching the stem 202 of the applicator 200 to the applicator coupler 300. In some embodiments, the stem coupler 306 is configured with a socket 308 or the like configured for receiving the proximal end 212 of the stem 202 in a press fit manner. In other embodiments, the proximal end 212 of the stem 202 can be glued, heat bonded, etc., to the stem coupler 306. In the illustrated embodiments, the stem coupler 306 optionally includes a tapered shape to increase strength and reduce failure of the coupling; however, in other embodiments, the stem coupler 306 is any suitable shape capable of retaining the stem 202 of the applicator assembly 200. In some embodiments, the features of the applicator coupler 300 are integral to the applicator assembly 200 and the separate applicator coupler 300 is omitted from the cosmetic formula container 100.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. An applicator for applying a cosmetic formula, the applicator comprising:

an elongate stem having a first end, a second end, and a perimeter; and a structured tip portion having a physical shape indicative of a trademark with a closed partition and an open partition that forms a leg segment, the structured tip portion coupled to and extending beyond the first end of the elongate stem and configured to retain an amount of the cosmetic formula for application, wherein the perimeter of the elongate stem is configured with a concave segment such that the elongate stem forms a longitudinal trough.

2. The applicator of claim 1, wherein the physical shape is sized and configured to apply an amount of the cosmetic formula to a biological surface.

3. The applicator of claim 1, wherein the structured tip portion comprises a physical shape representative of at least one alphanumeric character.

4. The applicator of claim 1, further comprising a cap coupled to the second end of the elongate stem.

5. The applicator of claim 4, wherein the cap has an internal threaded bore to interface with a bottle.

6. The applicator of claim 1, wherein the elongate stem includes a texture on a surface of the elongate stem from the first end toward the second end, the texture configured to increase surface area.

7. The applicator of claim 1, wherein the structured tip portion includes a texture on a surface of the structured tip portion configured to increase surface area.

8. The applicator of claim 1, wherein the leg segment is configured to provide spring bias upon contact with a surface.

9. The applicator of claim 1, wherein the elongate stem includes a material selected from the group consisting of nylon, high-density polyethylene (HDPE), low-density polyethylene (LDPE), plastic, thermo plastic, polymer, resin, thermal resin, or combinations or composites thereof.

10. A cosmetic formula container, comprising:

a container body having a neck and an interior cavity configured to hold a quantity of cosmetic formula;

a cap removably couplable to the neck for enclosing the cosmetic formula within the container; and an applicator coupled to the cap and extending into the interior cavity, the applicator comprising an elongate stem having a perimeter and a structured tip portion coupled to and extending beyond an end of the elongate stem opposite the cap, the structured tip portion having a physical shape indicative of a trademark, wherein the structured tip portion includes a closed partition and an open partition having a leg segment configured to provide spring bias upon contact with a surface, wherein the perimeter of the elongate stem is configured with a concave segment such that the elongate stem forms a longitudinal trough, and wherein the applicator is configured to retain an amount of the cosmetic formula for application.

11. The cosmetic formula container of claim 10, wherein the applicator includes a texture on at least a portion of a surface of the elongate stem configured to increase surface area for increased cosmetic formula retention.

12. The cosmetic formula container of claim 10, wherein the structured tip portion includes a texture on a surface of the structured tip portion configured to increase surface area for increased cosmetic formula retention.

13. The cosmetic formula container of claim 10, wherein the applicator further comprises a coupler coupled to the end of the elongate stem opposite the structured portion, the coupler having a coupling portion projecting from the body away from the elongate stem for coupling the applicator to the cap.

14. The cosmetic formula container of claim 10, wherein the applicator has a length such that the structured portion is between about 1/10 of 1 millimeter and about 5 millimeters away from an interior bottom of the container body when the cap is coupled to the neck of the container body.

15. The cosmetic formula container of claim 10, wherein the elongate stem includes a material selected from the group consisting of nylon, high-density polyethylene (HDPE), low-density polyethylene (LDPE), plastic, thermo plastic, polymer, resin, thermal resin, or combinations or composites thereof.

* * * * *